US005308729A

United States Patent [19]

Beach et al.

[11] Patent Number: 5,308,729

[45] Date of Patent: May 3, 1994

[54] ELECTROPHOTOGRAPHIC LIQUID DEVELOPER WITH CHARGE DIRECTOR

[75] Inventors: Bradley L. Beach; Carla M. Butler; Terence E. Franey; Ashok Murthy; Pramod K. Sharma; Ajay K. Suthar, all of Lexington, Ky.

[73] Assignee: Lexmark International, Inc., Greenwich, Conn.

[21] Appl. No.: 876,673

[22] Filed: Apr. 30, 1992

[51] Int. Cl.[5] ..... G03G 9/135

[52] U.S. Cl. ..... 430/115

[58] Field of Search ..... 430/114, 115

[56] References Cited

U.S. PATENT DOCUMENTS

| | | | |
|---|---|---|---|
| 4,707,429 | 11/1987 | Trout | 430/115 |
| 4,772,528 | 9/1988 | Larson et al. | 430/115 |
| 4,886,729 | 12/1989 | Grushkin et al. | 430/114 |
| 4,891,286 | 1/1990 | Gibson | 430/38 |
| 4,897,332 | 1/1990 | Gibson | 430/115 |
| 4,923,778 | 5/1990 | Blair et al. | 430/137 |
| 4,925,763 | 5/1990 | Tsubuko et al. | 430/106 |
| 5,019,477 | 5/1991 | Felder | 430/115 |
| 5,034,299 | 7/1991 | Houle et al. | 430/115 |
| 5,047,307 | 9/1991 | Landa et al. | 430/137 |
| 5,066,821 | 11/1991 | Houle et al. | 430/137 |
| 5,200,289 | 4/1993 | Harrington et al. | 430/115 |
| 5,206,108 | 4/1993 | Felder et al. | 430/115 |

*Primary Examiner*—John Goodrow
*Attorney, Agent, or Firm*—John A. Brady

[57] ABSTRACT

A liquid toner having a mineral oil vehicle, a blend of Surlyn ionomeric resin and Nucrel resin, pigment and, as charge director, lecithin, N-methyl-2-pyrrolidone and calcium Petronate. The charge director optimizes speed of recovery of charge properties during continual use. The mineral oil does not vaporize well and is readily condensed, thus permitting use as a confined toner.

15 Claims, No Drawings

ELECTROPHOTOGRAPHIC LIQUID DEVELOPER WITH CHARGE DIRECTOR

DESCRIPTION

1. Electrophotographic Liquid Developer With Charge Director Technical Field

This invention relates to electrophotographic imaging with liquid developers, and more specifically to the composition of a liquid developer having a charge director mixture.

2. Background of the Invention

Liquid developers are known having a pigment-containing resin or resin mixture, an inert organic liquid vehicle, and a charge director. This invention comprises a selection of materials to provide optimum results and is believed applicable with any inert pigment or coloring matter. The vehicle of this invention may be mineral oil, which is known for use as such a vehicle. The resin is a mixture of two resins which have been employed or mentioned in prior art as resins for such a liquid toner, but not in combination. The toner charge director is a combination including materials which have been employed or mentioned in prior art as charge directors, but not in the combination of this invention.

U.S. Pat. No. 5,047,307 to Landa et al at column 7 discloses mineral oil as a vehicle for such liquid toners. Similarly, U.S. Pat. No. 4,886,729 to Grushkin et al at column 4 is illustrative of other teachings of such use of mineral oil.

U.S. Pat. No. 4,925,763 to Tsubuko et al teaches ionomeric resins in toner with some blends, and with a separately added lauryl acrylate-acrylic acid resin in liquid toners. U.S. Pat. No. 5,034,299 to Houle et al at column 3 mentions Surlyn (trademark) ionomer resin and blends including that resin as the resin in such a liquid toner. U.S. Pat. No. 4,772,528 to Larson teaches blends of resins and mentions Surlyn in a list of suitable resins. Similarly, U.S. Pat. No. 4,923,778 to Blair et al at column 4 and U.S. Pat. No. 4,707,429 to Trout at column 4 are illustrative of other teachings of such use of Surlyn resin. This invention employs a Surlyn resin blended with a Nucrel (trademark) resin, a similar, but non-ionic resin. Nucrel resin, not combined with Surlyn resin, appears prominently in the liquid toner compositions disclosed in U.S. Pat. No. 5,019,477 to Felder. Similarly, Nucrel resin alone is disclosed in the Example of U.S. Pat. No. 4,891,286 to Gibson. The added acrylate-acrylic acid resin of the foregoing U.S. Pat. No. 4,925,763 has an acid component but in this patent the ionomeric component is mixed with the pigment and finely divided before being kneaded with the acrylate-acrylic acid resin.

The foregoing U.S. Pat. No. 4,707,429 to Trout teaches the Surlyn resin, lecithin as a charge control agent, calcium Petronate (trademark) as a charge control agent, and aluminum tristearate as an additive to such liquid toner compositions. The foregoing U.S. Pat. No. 4,772,528 discloses lecithin and calcium petronate and barium Petronate as charge control agents. Lecithin is widely taught as a charge control agent. U.S. Pat. No. 4,897,332 to Gibson teaches the combination of lecithin and alkylated N-vinyl pyrrolidone in combination as a charge control agent. Further illustrative teachings of lecithin, calcium Petronate, and aluminum tristearate appear in U.S. Pat. No. 5,066,821 to Houle et al at column 6. The foregoing U.S. Pat. No. 5,047,307 to Landa et al at column 19 is further illustrative of a use of calcium Petronate. The subject invention employs lecithin, aluminum tristearate, and calcium Petronate in combination with other material not included in the foregoing patents.

DISCLOSURE OF THE INVENTION

The toner of the present invention comprises mineral oil as a vehicle, fine particles of a thorough blend of ionomeric resin and a resin which is an acid form of an ionomeric resin, pigment, aluminum tristearate, and a separate charge control mixture added to the final mixture of the final materials. The charge control mixture is lecithin, N-methyl-2-pyrrolidone, and calcium Petronate as a 10%–30% solution in mineral oil. This charge control mixture is selected to optimize speed of recovery of charge properties during continual use.

BEST MODE FOR CARRYING OUT THE INVENTION

Sixty-four and eight-tenths (64.8) parts by weight Surlyn 9020, an ionomeric resin, a trademarked product of Du Pont Co., is mixed with forty-one and one-tenth (41.1) parts by weight Nucrel 599 resin, a trademarked product of Du Pont Co., an acid form of resin of otherwise the same structure as the Surlyn resins. Surlyn 9020 is a sodium ionomer having melt flow index of 1.0 and nominal density of 0.95. Thirty-five parts by weight of this combination of solids mixture is mixed with 65 parts by weight of Peneteck (trademark) mineral oil. Alternatively, Surlyn 7940, closely similar to Surlyn 9020, is employed as above described with Nucrel 699. Surlyn 7940 is a lithium ionomer having melt flow index of 2.6 and nominal density of 0.94. This produces a somewhat harder toner.

Peneteck mineral oil is described by the manufacturer as a food grade white mineral oil. It is highly purified to remove all aromatics and odor producing impurities. Analysis shows it consists of a mixture of straight chained and branched alkanes. The straight chain portion consists of about 25% of the total and is predominantly a mixture of C-14 to C-18 alkanes. The remaining 75% is a mixture of branched alkanes ranging predominantly from C-16 to C-19 has low volatility.

This mixture is mixed thoroughly as by double planetary mixing or screw extrusion at elevated temperatures (140°–160° C.) to a mixture in which the resins are thoroughly mixed and plasticized with mineral oil, and all of the mineral oil is completely incorporated into the resulting solid. Where extrusion is employed, the resulting solid may be extruded into cold water with chopping at the nozzle of the extruder. This product from the extruder is pellets having the general appearance of grains of rice. The solid is 21.6% Surlyn resin 14.4% Nucrel resin and 64% mineral oil. This may be termed the "plasticized product."

This product is ground one step further, if needed, in a high speed blender. This added step is needed in the case of the double planetary mixer. In the case of the extruder, the resulting product is in pellets that can go directly into an attritor.

To this product is added pigments, aluminum tristearate, and additional of the mineral oil in an amount to bring the total mineral oil content to 80 to 90% by weight. This is size reduced in an attritor for 6 to 14 hours until the final mixture has volume averaged particle diameter measured using a Shimadzu centrifugal particle size analyzer of about 1 to 3 microns. Preferred attrition is by Union Process model 1S attritor. (The attritor has a one gallon fluid capacity.) For that attritor, attritor speed may be 200 to 400 rpm. Attritor temperature is 20° to 70° C. Attritor temperature affects morphology and attritor speed affects the time to achieve desired particle size. Preferred temperature is 50° C. The resulting produce remains ten to twenty percent solids.

Total solids from the foregoing in each of black and three substractive colors for color imaging are as follows:

| | Solids by Weight % |
|---|---|
| Black | |
| Plasticized Product | 74.2 |
| Mogul-L (trademark) Carbon Black | 22.3 |
| NBS6157 violet dye | 2.3 |
| Alum. TriStearate | 1.2 |
| Cyan | |
| Plasticized Product | 81.7 |
| Toyo FG7341 cyan pigment | 16.8 |
| Alum. TriStearate | 1.5 |
| Magenta | |
| Plasticized Product | 78.0 |
| Mobay ER8616 magenta dye | 20.0 |
| Alum. TriStearate | 2.0 |
| Yellow | |
| Plasticized Product | 84.6 |
| Toyo FG1310 yellow dye | 15.7 |

After the attrition is completed, the mixture is diluted with the mineral oil to two percent solids with stirring. To each of the foregoing color formulas is added mixture of lecithin, N-methyl-2-pyrrolidone, and calcium Petronate in a 10–30% solution with the mineral oil until conductivity of approximately 50 picomhos/cm is reached.

This mixture is for charge control. It is formulated as follows: 20 grams of lecithin is dissolved in 500 ml of the mineral oil by stirring at room temperature, after the lecithin is dissolved, 15 ml of N-methyl-2-pyrrolidone is added with continued stirring. This causes an obvious turbidity in the solution. Then 20 grams of calcium petronate is added and dissolved with stirring. Finally, the mixture is centrifuged sufficiently to result in a clear, stable solution which can be decanted from any residue.

Roughly 2 ml of this charge director is required to charge 100 ml of the foregoing resin mixture to the 50 picomhos/cm.

The resulting toner is a negative liquid toner providing good-resolution printing and fixing at relatively moderate temperatures. The mineral oil vehicle does not vaporize well and is readily condensed, thus permitting use as a toner without significant environmental disturbance.

Important parameters to select are transfer efficiency, fuse grade and optical density. Transfer efficiency is the movement of images from surface to surface since this is done to move an image from a photoconductor surface to an intermediate roller where three colors and black are accumulated in registration, and then to a print roller. Transfer efficiency is measured by direct observation of extent of transfer in typical operation.

Fuse grade is a measure of permanence of final printing. It is determined by measuring the resistance of print in a typical operation to rubbing and scratching.

Optical density is measured on a colored block using a standard OD meter with different filters for different colors.

The foregoing formulas result from a selection balancing good results for the foregoing properties, as well as the necessary properties for liquid toning.

The charge control agent is selected to maximize recovery speed of electrical properties as toner is continually circulated in an active imaging system. Since mineral oil is a heavy vehicle, maximization of edge definition may be a more dominant design objective, and the charge control agent would then differ.

An important property of the charge director is termed "percent recovery." That is the percent of the original current generated after a high voltage spike is applied at 90 second intervals. The percent recovery is obtained using the following procedure:

The sample is placed in a cell with electrode diameters of 25 mm and a spacing of 1 mm. The voltage applied is 2000 volts for 7 seconds. The current vs time graph is displayed on an oscilloscope and the current maximum is recorded. The sample is allowed to "relax" for 1.5 minutes whereupon a second voltage of 2000 volts is applied. The current maximum is again recorded. The ratio of the second current to the first is the measure of "% recovery."

The electrodes must be cleaned with IPA and allowed to totally dry in-between samples.

The following table illustrates the importance of the presence of N-methyl-2-pyrrolidone (NM2P) to the % recovery. To a stock solution of 4% lecithin and 4% calcium Petronate, NM2P was added. The resulting charge director is used to charge the toner to a 50pmhos/cm level and percent recovery was measured.

| % NM2P Added | % Recovery |
|---|---|
| 0 | 52 |
| 0.8 | 68 |
| 1.5 | 75 |
| 3 | 90 |

Some of the data might lead one to speculate that the role of the NM2P may be nothing more than to select the correct solubility fraction of lecithin since the addition of NM2P does cause the solution to go cloudy and some lecithin is centrifuged out. To test that hypothesis a charge director was made up with Isopar-H (trademark isoparaffin) instead of the mineral oil so that after the centrifuge step the Isopar paraffin and the NM2P could be removed with evaporation. Then mineral oil can be added back, which results in a charge director containing the proper fraction of lecithin but without the presence of NM2P.

The following procedure was followed: 2 grams lecithin was dissolved with heat in Isopar-H paraffin. 2 grams of calcium Petronate and 1.5 ml NM2P were added. Stirring was continued in an ice bath to complete the precipitation of the lecithin. The sample was centrifuged and tested to show the initial percent recovery. Then the isopar and NM2P were evaporated off and 50 ml mineral oil was replaced. This sample was tested.

Also, to 25 ml of the mineral oil sample, 0.75 ml of NM2P was added back therefore the right solubility fraction of lecithin was confirmed.

The surprising result was that the sample which had the NM2P removed by evaporation did not have a stable conductivity. That is, a significant drop was observed over the first few hours of the dilution. The following table illustrates this property. 2 ml of each charge director was added to 100 ml the mineral oil and the conductivity was monitored with time.

| | CONDUCTIVITY (pmhos/cm) | |
|---|---|---|
| Time | W/NM2P | W/O NM2P |
| Initial | 59 | 160 |
| 15 min. | 55 | 67 |
| 1 hour | 52 | 60 |
| 1.5 hours | 52 | 56 |
| 4 hours | 52 | 53 |
| overnight | 52 | 53 |

This data suggest that the NM2P may play a role in micelle stabilization.

The following table contains the results from the % recovery testing of these samples.

| CD | TO T = 1:30 (current) | | % Recovery |
|---|---|---|---|
| Initial sample in Isopar-H | 1.74 | 1.54 | 88% |
| Sample with mineral oil replacement w/o NM2P | 2.5 | 1.44 | 57% |
| Sample with mineral oil replacement + NM2P (remained clear) | 1.66 | 1.52 | 91% |

The solubility of lecithin may contribute to the variation seen between 80 and 90% recovery BUT the presence of the NM2P does more than just select this solubility fraction. In addition to the % recovery being low for the sample without the NM2P, a surprising result of conductivity instability was observed. This suggests that the NM2P plays a role in stabilizing the micelles, that's why the conductivity drops so drastically without it.

Variations within the spirit and scope of this invention will be apparent.

We claim:

1. A liquid toner comprising mineral oil as a vehicle, resin particles comprising a thorough mixture of an ionomeric resin and the acid form of a resin otherwise of the same structural form of said ionomeric resin, said resins being in a ratio of about 6 parts by weight of said ionomeric resin to 4 parts by weight said acid resin, at least one pigment, and charge control materials.

2. A toner as in claim 1 in which said ionomeric resin is Surlyn 7940 resin and said acid-form resin is Nucrel 699 resin.

3. A toner as in claim 1 in which said ionomeric resin is Surlyn 9020 resin and said acid-form resin is Nucrel 599 resin.

4. The toner as in claim 2 also comprising aluminum tristearate.

5. The toner as in claim 3 also comprising aluminum tristearate.

6. The toner as in claim 1 also comprising aluminum tristrearate.

7. A liquid toner comprising mineral oil as a vehicle, resin particles comprising a thorough mixture of an ionomeric resin and the acid form of a resin otherwise of the same structural form of said ionomeric resin, said resins being in a ratio of about 6 parts by weight of said ionomeric resin 4 parts by weight of said acid resin, at least one pigment and, as charge control materials, lecithin, N-methyl-2-pyrrolidone, and calcium Petronate.

8. The toner as in claim 7 in which said ionomeric resin is Surlyn 7940 resin and said acid-form resin is Nucrel 699 resin.

9. The toner as in claim 7 in which said ionomeric resin is Surlyn 9020 resin and said acid-form resin is Nucrel 599 resin.

10. The toner as in claim 8 in which said lecithin, said pyrrolidone and said Petronate are in proportion of 20 grams lecithin, 15 ml pyrrolidone and 20 grams Petronate.

11. The toner as in claim 9 in which said lecithin, said pyrrolidone and said Petronate are in proportion of 20 grams lecithin, 15 ml pyrrolidone and 20 grams Petronate.

12. The toner as in claim 7 in which said lecithin, said pyrrolidone and said Petronate are in proportion of 20 grams lecithin, 15 ml pyrrolidone and 20 grams Petronate.

13. The toner as in claim 12 also comprising aluminum tristearate.

14. The toner as in claim 10 also comprising aluminum tristearate.

15. The toner as in claim 11 also comprising aluminum tristearate.

* * * * *